United States Patent [19]

Boss

[11] Patent Number: 4,538,397

[45] Date of Patent: Sep. 3, 1985

[54] METHOD AND APPARATUS FOR STORAGE OF PAPER SHEETS AND THE LIKE

[75] Inventor: Heinz Boss, Strengelbach, Switzerland

[73] Assignee: GRAPHA-Holding AG, Hergiswil, Switzerland

[21] Appl. No.: 501,018

[22] Filed: Jun. 6, 1983

[30] Foreign Application Priority Data

Jun. 15, 1982 [CH] Switzerland ..... 3682/82

[51] Int. Cl.[3] ..... B65B 63/04

[52] U.S. Cl. ..... 53/430; 53/118

[58] Field of Search ..... 53/430, 118, 593, 587, 53/556, 441, 211, 212, 214; 414/29, 32, 57, 68; 242/59, 67.2, 67.3 R, 67.4, 55, DIG. 2; 270/52, 54, 56, 52.5; 226/76; 271/151, 202, 203, 216

[56] References Cited

U.S. PATENT DOCUMENTS 1,867,596 7/1932 Roseman ..... 242/DIG. 2
3,749,330 7/1973 Gazzola et al. ..... 242/67.3 R
4,204,377 5/1980 Lancaster et al. ..... 53/587 X
4,438,618 3/1984 Honegger ..... 242/59 X

*Primary Examiner*—Horace M. Culver
*Attorney, Agent, or Firm*—Peter K. Kontler

[57] ABSTRACT

Successive sheets of a stream of partially overlapping or immediately following paper sheets are fed onto the upper side of an elastic band whose leader is attached to a horizontal core so that, when the core is driven, the band is convoluted therearound from below and its convolutions confine the sheets. The width of the band is a fraction of the axial length of the core, and that portion of the band which immediately precedes the outermost convolution on the core is caused to swivel back and forth continuously between two end positions which are mirror symmetrical to one another with reference to a plane that is normal to the axis of and halves the core. This ensures that the convolutions of the band are placed immediately next to or partially overlap each other.

18 Claims, 2 Drawing Figures

METHOD AND APPARATUS FOR STORAGE OF PAPER SHEETS AND THE LIKE

BACKGROUND OF THE INVENTION

The present invention relates to a method and apparatus for storage of sheets which consist of paper or the like. More particularly, the invention relates to improvements in a method and apparatus for temporarily storing sheets between the convolutions of a flexible band which is wound onto a rotary core.

It is already known to store successive sheets of a stream of partially overlapping or non-overlapping sheets between the convolutions of a flexible band which is wound onto the core of a reel or the like. The sheets are fed onto the upper side of that portion of the band which is about to be converted into the outermost convolution on the core of the reel, and such sheets are held against slippage in that they are confined between two neighboring convolutions. As a rule, the band is relatively wide so as to guarantee that it engages substantial portions of neighboring sheets. This is considered necessary in order to ensure that the sheets which are temporarily stored between the convolutions of the band cannot move relative to each other, i.e., that they can be removed from temporary storage in a predetermined relationship with reference to one another, namely, in orientations in which they are ready for admission to the next processing station, e.g., into a gathering machine or the like. The cost of a relatively wide band is substantial because the band must meet a number of requirements with a high or very high degree of accuracy. Moreover, the bulk of a relatively wide band is pronounced, the same as the bulk of convolutions and of confined paper sheets on the core of the reel. It is necessary to ensure that the compactness of the convoluted band match or closely approximate an optimum value, i.e., that the band be subjected to a predetermined tensional stress which is a prerequisite for proper retention of stored sheets. Tensioning of a relatively wide and heavy band necessitates the exertion of a pronounced force, the provision of a sturdy frame for the parts of the apparatus, and the use of large prime mover means for advancing the band lengthwise.

OBJECTS AND SUMMARY OF THE INVENTION

An object of the invention is to provide a novel and improved method of temporarily storing paper sheets or the like between the convolutions of a flexible band whose width can be a small fraction of the width of a belt which is used for the practice of heretofore known methods.

Another object of the invention is to provide a method which ensures proper retention of a substantial number of sheets between the convolutions of a relatively narrow band whose width is a small fraction of the axial length of the reel whereon the sheets are stored.

A further object of the invention is to provide a method of the above outlined character according to which the number of convolutions which confine successive increments of a stream of sheets can be varied within a wide range.

An additional object of the invention is to provide a method which can be used for storage of sheets on a relatively short core, on a core of medium length or on a relatively long core.

Still another object of the invention is to provide a novel and improved apparatus for the practice of the above outlined method and to construct and assemble the apparatus in such a way that a relatively narrow band can store a large number of sheets in a small area on a short, medium long or long core of a takeup reel.

A further object of the invention is to provide the apparatus with novel and improved means for guiding the band between the source of supply of such band and the point of merger of successive increments of the running band into the outermost convolution on the core of the takeup reel.

An additional object of the invention is to provide a highly versatile apparatus which can be adjusted with little loss in time to convolute the band onto short, medium long or long cores and which can employ bands of any one of a wide variety of different widths.

A further object of the invention is to provide an apparatus which can be used as a superior substitute for heretofore known apparatus for temporary storage of paper sheets or the like between a producing and a processing machine or between two processing stations.

One feature of the invention resides in the provision of a method of temporarily storing sheets which consist of paper or the like on a relatively narrow elongated band whose leader is connected to a core having an axial length exceeding the width of the band. The method comprises the steps of feeding a stream of sheets onto the band, rotating the core so that the band is moved lengthwise and is convoluted onto the core to form a series of convolutions which confine the sheets therebetween, and moving successive increments of the moving band back and forth substantially in the axial direction of the core at a location which is remote from the core or from the outermost convolution on the core so that successive convolutions of the band are at least partially staggered with reference to each other, as considered in the axial direction of the core. Successive sheets of the stream can partially overlap each other, or such sheets can be disposed one after the other so that the leader of each trailing sheet is located behind the trailing end of the respective preceding sheet.

The moving step can include swivelling the band portion between the aforementioned location and the outermost convolution of the band back and forth between two spaced apart end positions which are at least substantially mirror symmetrical to one another with reference to a plane that is normal to the axis of and halves the core whereby the convolutions of the band on the core form at least one layer of spirals and the convolutions or spirals of each layer are staggered, as considered in the axial direction of the core. The swivelling step can include moving successive increments of the moving band at the aforementioned location back and forth at a speed which is selected in such a way that the neighboring convolutions are staggered with reference to one another to an extent at most equaling the width of the band. The rotating step can comprise causing the core to perform between 0.2 and 20 revolutions during the interval which elapses for movement of the aforementioned band portion from the one to the other and back to the one end position.

The method preferably further comprises the steps of establishing a source of supply of band and locating the source in such position that the band portion which is drawn from the source in response to rotation of the core advances along a path extending at least substantially tangentially of the core and being disposed at a level below the core. The core is preferably rotated about a substantially horizontal axis. The feeding step preferably comprises delivering successive sheets of the stream onto the upper side of the band portion between the source and the core. If the band is stretchable (such band can be made of an elastomeric material), the method preferably further comprises the step of stretching the band portion between the source and the outermost convolution on the core so that the convolutions of the band bear against and prevent slippage of the adjacent sheets.

Another feature of the invention resides in the provision of an apparatus for temporary storage of sheets which consist of paper or the like on a core between the convolutions of an elongated flexible band having a width less than the axial length of the core. The apparatus comprises means for rotating the core (preferably about an at least substantially horizontal axis) which is connected with the leader of the band so that rotation of the core about its axis results in convolution of the band therearound, means for feeding to the band a stream of successive sheets ahead of the core, as considered in the direction of advancement of the band toward the outermost convolution on the core, so that the sheets are confined between successive convolutions of the band, and means for swivelling a portion of the band ahead of the outermost convolution back and forth, as considered in the axial direction of the core, so that the convolutions of the band are staggered in the axial direction of the core. The apparatus preferably contains a bobbin or another suitable source of supply of band and has means defining for the band an elongated path extending between the source of supply and the outermost convolution of the band on the core. The swivelling means can comprise a pair of idler rolls or analogous lateral guides flanking the band in a selected portion of the aforementioned path which is remote from the core, and means for moving the two guides jointly in substantial parallelism with the axis of the core. The moving means can comprise a lever which supports the two guides and means for rocking the lever back and forth about an axis which is remote from and extends at right angles to the axis of the core. The moving means can move the guides between two end positions which are at least substantially mirror symmetrical to one another with reference to a plane extending at right angles to the axis of and halving the core. Such moving means can form part of the means for rotating the core, and the rotating means can further comprise means for synchronizing the movements of the guides with the angular movement of the core.

The band portion in the aforementioned path is at least substantially tangential to the core or to the outermost convolution on the core, and the feeding means preferably comprises a suitable conveyor which delivers sheets onto the upper side of the band portion in the path. Such path is preferably disposed at a level below the core.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
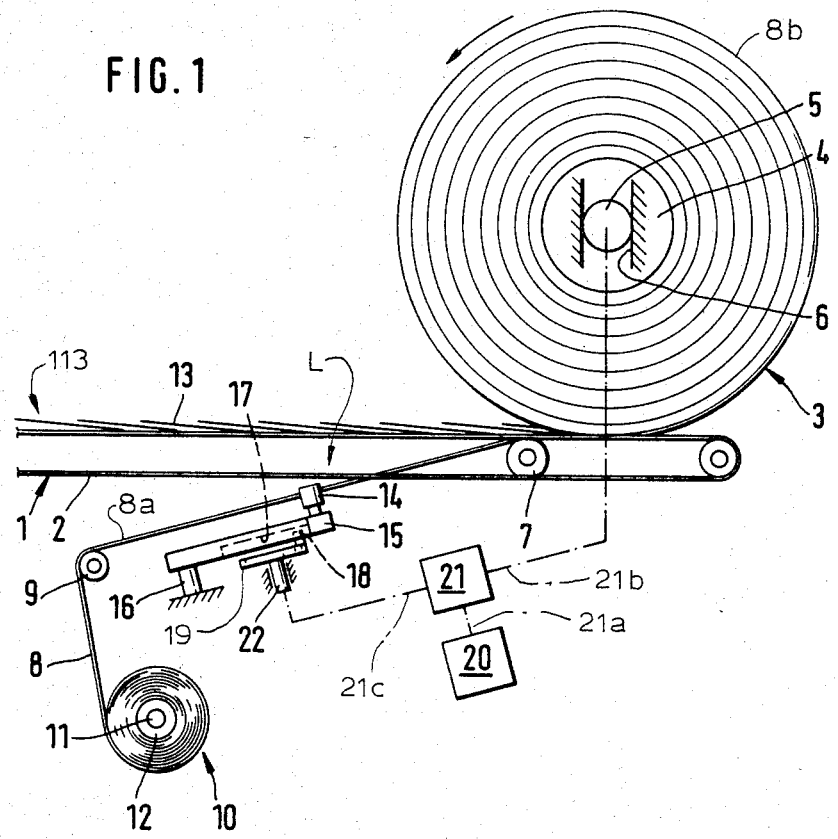
FIG. 1 is a schematic side elevational view of an apparatus for temporary storage of paper sheets which embodies one form of the invention, a substantial length of the band being converted into convolutions which surround the core.

The drawing shows an apparatus wherein a sheet transporting or feeding unit 1 comprises two spaced apart parallel belt conveyors 2 whose upper reaches advance successive sheets 13 of a stream 113 of partly overlapping sheets onto the upper side of an elongated portion 8*a* of a stretchable elastic band 8 which is supplied by a source 10 and whose leader is connected to a horizontal core 4 forming part of a roll 3 which further includes convolutions 8*b* of the band 8 and those sheets 13 of the stream 113 which are temporarily stored between the neighboring convolutions 8*b*. The band portion 8*a* extends substantially tangentially of the outermost convolution 8*b* and is disposed in an elongated path defined by two guide rolls 7 and 9 extending in parallelism with the core 4 and being mounted in the frame (not specifically shown) of the improved apparatus. It will be noted that the path which is defined by the rolls 7 and 9 is disposed at a level below the core 4. The latter has coaxial stub shafts 5 which are rotatable and movable sideways (up and down, as viewed in FIG. 1) in stationary bearings 6 forming part of or mounted in the aforementioned frame. If desired, the illustrated bearings 6 can be replaced with bearings which allow the stub shafts 5 to rotate but prevent the core 4 from moving up and down. The illustrated feeding unit 1 is then replaced with a feeding unit whose right-hand end portion (as viewed in FIGS. 1 and 2) is biased upwardly toward the core 4 or toward the outermost convolution 8*b* of the band 8. In the illustrated embodiment, the outermost convolution 8*b* rests on the upper reaches of the belt conveyors 2 under its own weight as well as the combined weight of all temporarily stored sheets 13 and the core 4.

Figure 2:
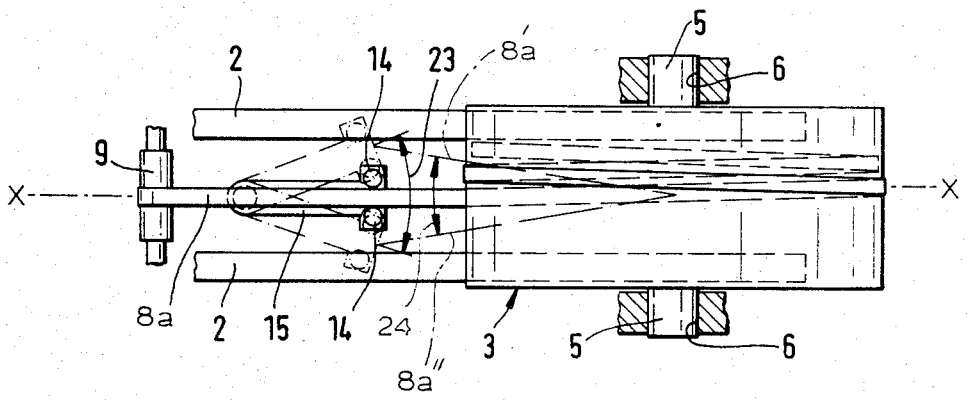
FIG. 2 is a schematic plan view of the structure which is shown in FIG. 1.

As can be seen in FIG. 2, the path which is defined by the guide rolls 7 and 9 is disposed between the two conveyors 2 so that the band portion 8*a* has freedom of swivelling movement in the directions indicated by a double-headed arrow 23 between a first end position which is indicated by the phantom line 8*a*′ and a second end position 8*a*″ which is also indicated by a phantom line. The lines 8*a*′ and 8*a*″ are mirror symmetrical to one another with reference to a vertical plane X—X which extends at right angles to the horizontal axis of the core 4 and is disposed at least substantially midway between the stub shafts 5. The guide rolls 7 and 9 are idler rolls, and the roll 7 can also serve as a guide for intermediate portions of the upper reaches of the conveyors 2.

The source 10 comprises a core 12 with two coaxial stub shafts 11 (only one can be seen in FIG. 1) which are rotatable in the frame of the apparatus. The means for rotating the core 4 and for thereby advancing the band 8 from the source 10 toward the core comprises a prime mover 20 (e.g., a variable-speed electric motor) and a transmission 21 having an input element 21*a* driven by the prime mover 20 and two output elements 21*b*, 21*c*. The output element 21*b* drives the core 4 in a counterclockwise direction, as viewed in FIG. 1, when the apparatus is to store a number of sheets 13, and the output element 21*c* serves to transmit torque to a shaft 22 which is journalled in the frame and forms part of means for swivelling the band portion 8*a* back and forth between the aforementioned end positions 8*a'* and 8*a''*. The prime mover 20 is preferably a reversible motor so that it can rewind the band 8 onto the core 12 when the sheets 13 are to be removed from the magazine which includes the core 4.

The aforementioned swivelling means comprises a pair of roller-shaped lateral guides 14 which flank the band portion 8*a* at a location L and are remote from the core 4 and from the outermost convolution 8*b* on the core. The guides 14 are mounted on the free end portion of a one-armed lever 15 which can be rocked back and forth about the axis of a shaft 16 mounted in the frame and extending at right angles to the core 4. The means for continuously rocking the lever 15 comprises a disc 19 which is driven by the shaft 22 and carries an eccentric pin 18 extending into a longitudinally extending groove 17 machined into the underside of the lever 15. The ratio of the transmission 21 is selected in such a way that, for each revolution of the disc 18 (i.e., for each movement of the guides 14 from the position 8*a'* to the position 8*a''* and back to the position 8*a'*, the core 4 can perform between 0.2 and 20 revolutions.

The throw of the eccentric pin 18 can be adjusted by mounting this pin on the disc 19 for movement toward or away from the axis of the shaft 22. A nut or other suitable means can be provided to releasably hold the pin 18 in a selected position. Such adjustability of the pin 18 ensures that the apparatus can convolute a relatively narrow band 8 onto cores of different axial lengths. Each adjustment of the pin 18 with reference to the common axis of the disc 19 and shaft 22 results in selection of two different end positions (8*a'*, 8*a''*) of the band portion between the guides 14 and the outermost convolution 8*b* on the core 4. In other words, adjustability of the pin 18 renders it possible to change the magnitude of the angle 24 between the end positions 8*a'* and 8*a''*.

The transmission 21 synchronizes the movements of the lever 15 and its guides 14 with the angular movement of the core 4 in such a way that neighboring convolutions 8*b* of the band 8 partially overlap each other or, at most, are disposed immediately next to one another (as considered in the axial direction of the core). If the ratio of the transmission 21 is adjustable, the operator can select the extent to which neighboring convolutions 8*b* of the band 8 are staggered with respect to each other, as considered in the axial direction of the core 4. Such convolutions can form one, two or more layers of neighboring or partially overlapping spiral convolutions, and the pitch of neighboring convolutions in each layer is different due to the fact that the band portion 8*a* is caused to swivel back and forth in that portion of its path which extends from the location L of the guides 14 to the outermost convolution 8*b* on the core 4. Partial overlapping of neighboring convolutions 8*b*, or the placing of neighboring convolutions into immediate proximity to one another (as considered in the axial direction of the core 4) ensures that the sheets 13 are reliably held during temporary storage in the magazine including the core 4. The core 12 is or can be braked so that it opposes lengthwise movement of the band 8 toward the core 4, i.e., the elastically deformable band is stretched to further reduce the likelihood of shifting of stored sheets 13 between the neighboring convolutions 8*b*. Absence of gaps between neighboring convolutions 8*b*, as considered in the axial direction of the core 4, further ensures that the stored sheets are not creased by the marginal portions of the respective convolutions.

Each sheet 13 can comprise a single layer or it may be made of one or more individual panels which are folded so that they partially or fully overlap each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of temporarily storing sheets which consist of paper or the like on a relatively narrow elongated band whose leader is connected to a core having an axial length exceeding the width of the band, comprising the steps of feeding a stream of sheets onto the band; rotating the core so that the band is moved lengthwise and is convoluted onto the core to form a series of convolutions which confine the sheets therebetween; and moving successive increments of the moving band back and forth without twisting of the band and substantially in the axial direction of the core at a location which is remote from the outermost convolution so that successive convolutions are at least partially staggered with reference to each other, as considered in the axial direction of the core.

2. The method of claim 1, wherein successive sheets of the stream partially overlap each other.

3. The method of claim 1, wherein the sheets of the stream are disposed one after the other so that the leader of each trailing sheet is located behind the trailing end of the respective preceding sheet.

4. The method of claim 1, wherein said moving step includes swiveling the band portion between said location and the outermost convolution back and forth between two spaced apart end positions which are substantially mirror symmetrical to each other with reference to a plane that is normal to the axis of and halves the core whereby the convolutions of the band on the core form at least one layer of spirals and the convolutions of such layer are staggered, as considered in the axial direction of the core.

5. The method of claim 4, wherein said swivelling step includes moving successive increments of the moving band at said location back and forth at a speed such that the neighboring convolutions are staggered with reference to each other to an extent at most equaling the width of the band.

6. The method of claim 4, wherein said rotating step comprises causing the core to perform between 0.2 and 20 revolutions during the interval which elapses for movement of said band portion from the one to the other and back to the one end position.

7. The method of claim 1, further comprising the steps of establishing a source of supply of band and locating the source in such position that the band portion which is drawn from the source in response to rotation of the core advances along a path extending substantially tangentially of and being disposed at a level below the core.

8. The method of claim 7, wherein the rotating step comprises rotating the core about a substantially horizontal axis.

9. The method of claim 8, wherein the band portion in said path has an upper side and said feeding step includes delivering successive sheets of the stream onto the upper side of such band portion.

10. The method of claim 9 of storing sheets on a stretchable band, further comprising the step of stretching the band portion between the source and the core so that the convolutions of the band bear against and prevent slippage of the adjacent sheets.

11. Apparatus for temporary storage of sheets which consist of paper or the like on a core between the convolutions of an elongated flexible band having a width less than the axial length of the core, comprising means for rotating the core, the band having a leader which is connected to the core so that rotation of the core results in convolution of the band therearound; means for feading to the band a stream of successive sheets ahead of the core, as considered in the direction of advancement of the band toward the outermost convolution on the core, so that the sheets are confined between successive convolutions of the band; and means for swivelling a portion of the band ahead of the outermost convolution and without twisting of the band back and forth, as considered in the axial direction of the core, so that the convolutions of the band are staggered in the axial direction of the core.

12. The apparatus of claim 11, wherein the band is withdrawn from a source of supply of band and further comprising means defining for the band an elongated path extending between the source and the outermost convolution on the core, said rotating means being arranged to advance the band along said path without twisting of the band all the way between the source and the outermost convolution on the core.

13. The apparatus of claim 12, wherein said swivelling means comprises a pair of lateral guides flanking the band in a portion of said path which is remote from the core and means for moving said guides jointly in substantial parallelism with the axis of the core.

14. The apparatus of claim 13, wherein said moving means comprises a lever supporting said guides and means for rocking said lever back and forth about an axis which is remote from and extends at right angles to the axis of the core.

15. The apparatus of claim 13, wherein said moving means includes means for moving said guides between two end positions which are at least substantially mirror symmetrical to each other with reference to a plane extending at right angles to the axis of and halving the core.

16. The apparatus of claim 15, wherein said moving means forms part of said rotating means and said rotating means further includes means for synchronizing the movements of said guides with the angular movement of the core.

17. The apparatus of claim 12, wherein the core is substantially horizontal and the band portion in said path has an upper side and is substantially tangential to the core, said feeding means including conveyor means arranged to deliver sheets onto the upper side of said band portion.

18. The apparatus of claim 17, wherein said path is disposed at a level below the core.

* * * * *